US009604128B2

(12) United States Patent
Stellenberg

(10) Patent No.: US 9,604,128 B2
(45) Date of Patent: Mar. 28, 2017

(54) PINBALL MACHINE WITH HYBRID PLAYFIELD

(71) Applicant: Multimorphic, Inc., Austin, TX (US)

(72) Inventor: Gerald Stellenberg, Austin, TX (US)

(73) Assignee: Multimorphic Inc., Austin, TX (US)

( * ) Notice: Subject to any disclaimer, the term of this patent is extended or adjusted under 35 U.S.C. 154(b) by 0 days.

(21) Appl. No.: 13/734,151

(22) Filed: Jan. 4, 2013

(65) Prior Publication Data

US 2013/0214484 A1 Aug. 22, 2013

Related U.S. Application Data

(60) Provisional application No. 61/632,002, filed on Jan. 7, 2012, provisional application No. 61/632,749, filed (Continued)

(51) Int. Cl.
*A63F 7/22* (2006.01)
*A63F 7/02* (2006.01)

(Continued)

(52) U.S. Cl.
CPC ..... *A63F 7/027* (2013.01); *G07F 17/323* (2013.01); *G07F 17/3213* (2013.01);

(Continued)

(58) Field of Classification Search
CPC ..... A63F 7/022; A63F 7/025; A63F 7/027

(Continued)

(56) References Cited

U.S. PATENT DOCUMENTS 4,075,620 A 2/1978 Passavant
4,189,145 A 2/1980 Stubben et al.

(Continued)

FOREIGN PATENT DOCUMENTS

EP 0737495 A1 10/1994
WO WO8401908 A1 5/1984

OTHER PUBLICATIONS

Pinball News, P3 Pinball Platform, published on Mar. 23, 2012 at http://www.pinballnews.com/learn/p3, last accessed on Dec. 28, 2012.

(Continued)

*Primary Examiner* — Dmitry Suhol
*Assistant Examiner* — Ankit Doshi
(74) *Attorney, Agent, or Firm* — Boisbrun Hofman, PLLC

(57) ABSTRACT

Pinball machines with hybrid playfields. A method may include electronically determining a physical property of a physical object, the physical object allowed to move above a display disposed within a playfield of a pinball machine, and rendering a virtual object on the display in response to an evaluation of the physical property. Another method may include rendering a virtual object on an electronic screen, the electronic screen disposed within a playfield of the pinball machine, and changing an aspect of a physical object located within the playfield in response to the virtual object exhibiting a predefined property. Yet another method may include providing a list of one or more software applications via an electronic display arranged within the playfield of the pinball machine, allowing a user to select one of the one or more software applications, and executing the selected software application.

16 Claims, 10 Drawing Sheets

Related U.S. Application Data on Jan. 31, 2012, provisional application No. 61/633,559, filed on Feb. 14, 2012.

(51) Int. Cl.
*G07F 17/32* (2006.01)
*A63F 9/24* (2006.01)

(52) U.S. Cl.
CPC ..... *G07F 17/3216* (2013.01); *G07F 17/3272* (2013.01); *A63F 2009/246* (2013.01); *A63F 2009/2442* (2013.01); *G07F 17/3295* (2013.01); *G07F 17/3297* (2013.01)

(58) Field of Classification Search
USPC ..... 463/20
See application file for complete search history.

(56) References Cited

U.S. PATENT DOCUMENTS

| | | | | |
|---|---|---|---|---|
| 4,359,223 | A | 11/1982 | Baer et al. | |
| 4,367,876 | A | 1/1983 | Kotoyori | |
| 4,375,286 | A * | 3/1983 | Seitz et al. | 273/121 A |
| 4,448,417 | A * | 5/1984 | Clark et al. | 273/121 A |
| 4,710,873 | A | 12/1987 | Breslow et al. | |
| 4,853,764 | A | 8/1989 | Sutter | |
| 5,190,286 | A | 3/1993 | Watanabe et al. | |
| 5,316,303 | A | 5/1994 | Trudeau et al. | |
| 5,327,284 | A | 7/1994 | Kuester | |
| 5,351,966 | A | 10/1994 | Tohyama | |
| 5,418,579 | A | 5/1995 | Jamieson | |
| 5,421,589 | A | 6/1995 | Monroe | |
| 5,553,864 | A | 9/1996 | Sitrick | |
| 5,639,151 | A | 6/1997 | McNelley et al. | |
| 5,669,685 | A | 9/1997 | Kotani et al. | |
| 5,685,625 | A | 11/1997 | Beaver | |
| 5,971,396 | A * | 10/1999 | Wieland | 273/317.1 |
| 6,000,697 | A | 12/1999 | Popadiuk | |
| 6,036,188 | A | 3/2000 | Gomez et al. | |
| 6,036,189 | A | 3/2000 | Gomez et al. | |
| 6,129,353 | A | 10/2000 | DeMar et al. | |
| 7,075,026 | B2 | 7/2006 | Huang et al. | |
| 7,736,228 | B2 | 6/2010 | Seelig et al. | |
| 2005/0245302 | A1 * | 11/2005 | Bathiche et al. | 463/1 |
| 2010/0160016 | A1 * | 6/2010 | Shimabukuro et al. | 463/16 |
| 2011/0263312 | A1 * | 10/2011 | De Waal et al. | 463/20 |
| 2013/0147111 | A1 | 6/2013 | Popadiuk | |

OTHER PUBLICATIONS

Pinball News, P3 Update:Team Adds New Game Designer, published on Dec. 5, 2012 at http://www.pinballnews.com/games/p3/index4.html, last accessed on Dec. 28, 2012.

Stellenberg, "Custom pinball machine—interactive playfield prototype," accessible at http://www.youtube.com/watch?v=Ek4F56AwAqE, uploaded on Sep 3, 2011.

* cited by examiner

PINBALL MACHINE WITH HYBRID PLAYFIELD

CROSS-REFERENCE TO RELATED APPLICATIONS

This application claims the benefit of the filing date of U.S. Provisional Pat. App. No. 61/632,002 titled "Interactive Playfield with Comprehensive Position Tracking in an Amusement Game" and filed on Jan. 17, 2012, of U.S. Provisional Pat. App. No. 61/632,749 titled "Graphical Elements Representing and Affecting Physical Elements in a Pinball Machine" and filed on Jan. 31, 2012, and of U.S. Provisional Pat. App. No. 61/633,559 titled "Multiple Game Pinball Machine" and filed on Feb. 14, 2012, the disclosures of which are hereby incorporated by reference herein in their entirety.

FIELD

This document relates generally to gaming devices, and more specifically, to pinball machines with hybrid playfields.

BACKGROUND

A pinball machine is an entertainment or amusement device usually found in a variety of public places such as arcades, restaurants, bars, clubs, etc., but sometimes also present in private residences and other environments. Generally speaking, a conventional or traditional pinball machine allows players to play a game in which points are earned by physically manipulating one or more steel balls on a slightly inclined playfield within a glass-covered cabinet.

The pinball machine's playfield typically includes one or more physical targets. When a ball strikes a particular physical target, an electromechanical switch coupled to (or otherwise integrated into) the target detects the mechanical impact, which then triggers a change in some aspect of the game. For example, in some cases, when a ball hits a given target, a player may score a predetermined amount of points.

In most pinball implementations, a "hole" or "drain" is located at the bottom portion of the playfield. Usually, if the ball falls into the drain, the game ends or another ball is provided to the player. Mechanical "flippers" capable of at least partially covering the drain may allow a skilled player to hit the ball at an appropriate time so as to prevent it from falling into the drain, thus putting that same ball back in play and extending the duration of the game.

SUMMARY

Pinball machines with hybrid playfields are described. In an illustrative, non-limiting embodiment, a method may include electronically determining a physical property of a physical object, where the physical object is allowed to move above a display disposed within a playfield of a pinball machine, and rendering a virtual object on the display in response to an evaluation of the physical property. For example, the physical object may include at least one of: a ball, a flipper, a slingshot, a kicker, a bumper, a target, a plunger, a hole, a saucer, a spinner, a gate, a switch, a stopper, a ramp, or a magnet. Moreover, the physical property may include at least one of: a position of the physical object on the playfield, a speed of the physical object over the playfield, or a direction of movement of the physical object across the playfield.

In some implementations, the evaluation of the physical property may include at least one of: a determination that the position of the physical object matches a predetermined position on the playfield, a determination that the speed of the physical object matches a predetermined speed over the playfield, or a determination that the direction of movement of the physical object matches a predetermined direction across the playfield. Additionally or alternatively, the evaluation of the physical property may include at least one of: a determination that the position of the physical object does not match a predetermined position on the playfield, a determination that the speed of the physical object does not match a predetermined speed over the playfield, or a determination that the direction of movement of the physical object does not match a predetermined direction across the playfield.

In some cases, rendering the virtual object may include modifying a previously-rendered virtual object to simulate a physical interaction between the physical object and the previously-rendered virtual object that results in the virtual object. Also, the simulated physical interaction may be of a magnitude proportional to a value of the physical property. For example, modifying the previously-rendered virtual object may include at least one of: moving the previously-rendered virtual object between different positions on the display, changing a shape of the previously-rendered virtual object, changing a color of the previously-rendered virtual object, or changing a size of the previously-rendered virtual object.

In another illustrative, non-limiting embodiment, a pinball machine may include a memory configured to store instructions and a processing circuitry operably coupled to the memory, the processing circuitry configured to execute the instructions to cause the pinball machine to: render a virtual object on an electronic screen, the electronic screen disposed within a playfield of the pinball machine, and change an aspect of a physical object located above the electronic screen and within the playfield in response to the virtual object exhibiting a predefined property.

In some cases, changing the aspect of the physical object may include simulating a physical interaction between the physical object and the virtual object. The physical interaction may be configured to affect progress of a game played on the pinball machine. For example, the aspect of the physical object may include at least one of: shape of the physical object, a position of the physical object, a speed of the physical object, or a direction of movement of the physical object, a light emitted by the physical object, a color of the physical object, or a sound emitted by the physical object. Moreover, the predefined property may include at least one of: a distance between the virtual object and the physical object, a speed of the virtual object relative to the physical object, or a direction of movement of the virtual object relative to the physical object.

In some implementations, the processing circuitry may be configured to execute the instructions to cause the pinball machine to, in response to changing the aspect of the physical object, modify the virtual object. For instance, the property of the virtual object may include at least one of: a shape of the virtual object, a color of the virtual object, a texture of the virtual object, a size of the virtual object, a position of the virtual object, a speed of the virtual object, or a direction of movement of the virtual object.

In yet another illustrative, non-limiting embodiment, a non-transitory computer-readable storage medium may have program instructions stored thereon that, upon execution by a processor within a pinball machine, cause the pinball machine to: provide a list of one or more software applications via an electronic display arranged within the playfield of the pinball machine, allow a user to select one of the one or more software applications, and execute the selected software application. For example, the list of one or more software applications may include one or more distinct pinball games.

In some cases, the one or more distinct pinball games may be stored in a library remotely located with respect to the pinball machine. Also, the pinball machine may allow a first user to play a portion of a first pinball game, it may allow a second user to play a portion of a second pinball game after having allowed the first user to play the first portion of the first pinball game, and it may allow the first user to play a subsequent portion of the first pinball game after having allowed the second user to play the portion of the second pinball game.

BRIEF DESCRIPTION OF THE DRAWINGS

The present invention(s) is/are illustrated by way of example and is/are not limited by the accompanying figures, in which like references indicate similar elements. Elements in the figures are illustrated for simplicity and clarity and have not necessarily been drawn to scale.

DETAILED DESCRIPTION

Systems and methods disclosed herein are directed to pinball machines with hybrid playfields and methods of operating the same. Generally speaking, some of these systems and methods may be incorporated into, or otherwise combined with, a wide range of other entertainment or amusement devices, including, but not limited to, video games, electro-mechanical games, redemption games, merchandisers, billiards, shuffleboards, table football ("Foosball"), table tennis ("Ping-Pong"), air hockey tables, etc. These systems and methods may also be incorporated into gambling devices, such as slot machines, pachinko machines, or the like. It should be noted, however, that some of the techniques discussed herein may be uniquely applicable to devices that allow a player to manipulate a physical object within a playfield without directly touching that physical object (e.g., pinball machines).

Figure 1:
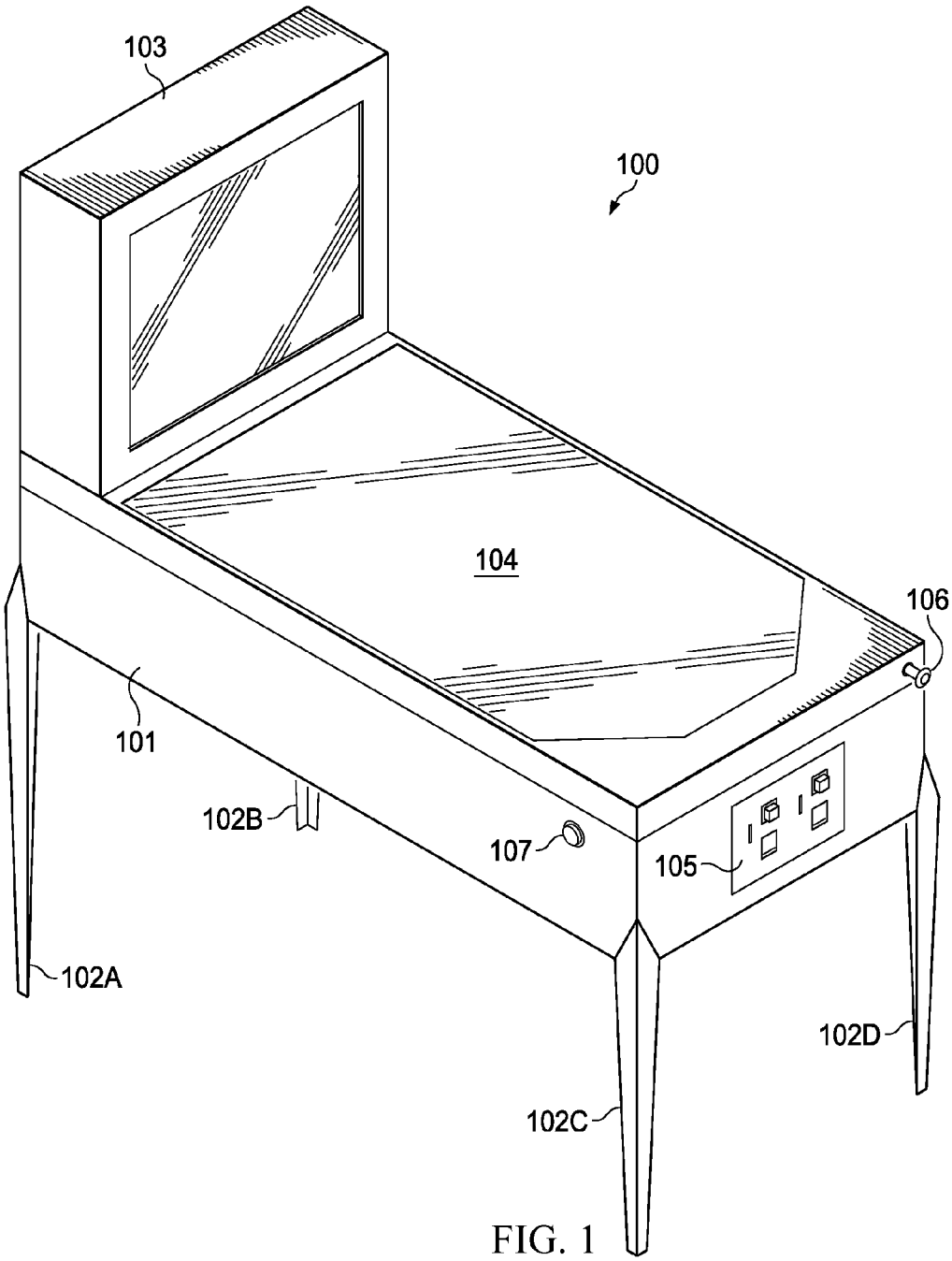
FIG. 1 is a three-dimensional, auxiliary view of an example of a pinball machine according to some embodiments.

Turning to FIG. 1, a three-dimensional, auxiliary view of an example of pinball machine 100 is depicted according to some embodiments. As illustrated, cabinet 101 stands on legs 102A-D, although in other implementations legs 102A-D may be absent and cabinet 101 may sit on a stand, desk, table, countertop, or the like. Cabinet 101 includes hybrid playfield 104, where a game of pinball may take place. Examples of hybrid playfield 104 are discussed in more detail below. In some cases, legs 102A and 102B may be slightly longer than legs 102C and 102D, such that playfield 104 may have an angle of approximately 3.5° to 10.5° with respect to the ground ("pitch"). In other cases, legs 102A-D may each have the same length, and cabinet 101 may be constructed so as to provide a suitable pitch to hybrid playfield 104.

Vertical portion 103 may include one or more electronic displays, video cameras, loudspeakers, etc. Generally speaking, vertical portion 103 may include or otherwise present certain audio-visual information, whether related or unrelated to a pinball game playable on machine 100 (e.g., promotional or marketing materials, etc.).

To enable a player to play a pinball game, front control(s) 105 may allow the user or player to deposit money or tokens into machine 100. As such, front control(s) 105 may include, for example, a credit, coin or token receiver, a magnetic card reader, a Radio Frequency Identification (RFID) scanner, or the like. Front control(s) 105 may also include one or more buttons that allow a user to select a number of players for a particular game, or to simply to start a pinball game. Meanwhile, side control(s) 107 and playfield control(s) 106 allow the user to operate one or more physical objects within hybrid playfield 104. As an example, side control(s) 107 (and/or a corresponding control on the opposite side of cabinet 101, not shown) may include one more buttons that allow a player to control mechanical "flippers." As another example, playfield control(s) 106 may include one or more buttons or mechanisms that allow the player to control a "plunger" element configured to put a steel ball in play during a pinball game.

Here it should be noted that pinball machine 100 is provided by way of illustration only. In different applications, machine 100 may assume a variety of shapes and forms. Furthermore, one or more components discussed above may be absent or different from what is depicted in FIG. 1. For example, in some cases, front control(s) 105 may be located elsewhere on machine 100, and, in other cases, may include more or fewer elements than shown. For instance, when designed for residential or personal use, machine 100 may not be credit, coin or token-operated.

Similarly, side control(s) 107 and/or playfield control(s) 106 may be replaced with motion detection devices (e.g., integrated into vertical portion 103), or may not be necessary for certain games. For example, if steel balls are provided within playfield 104 via an internal mechanism within machine 100, then playfield control(s) 106 may not be necessary.

Figure 2:
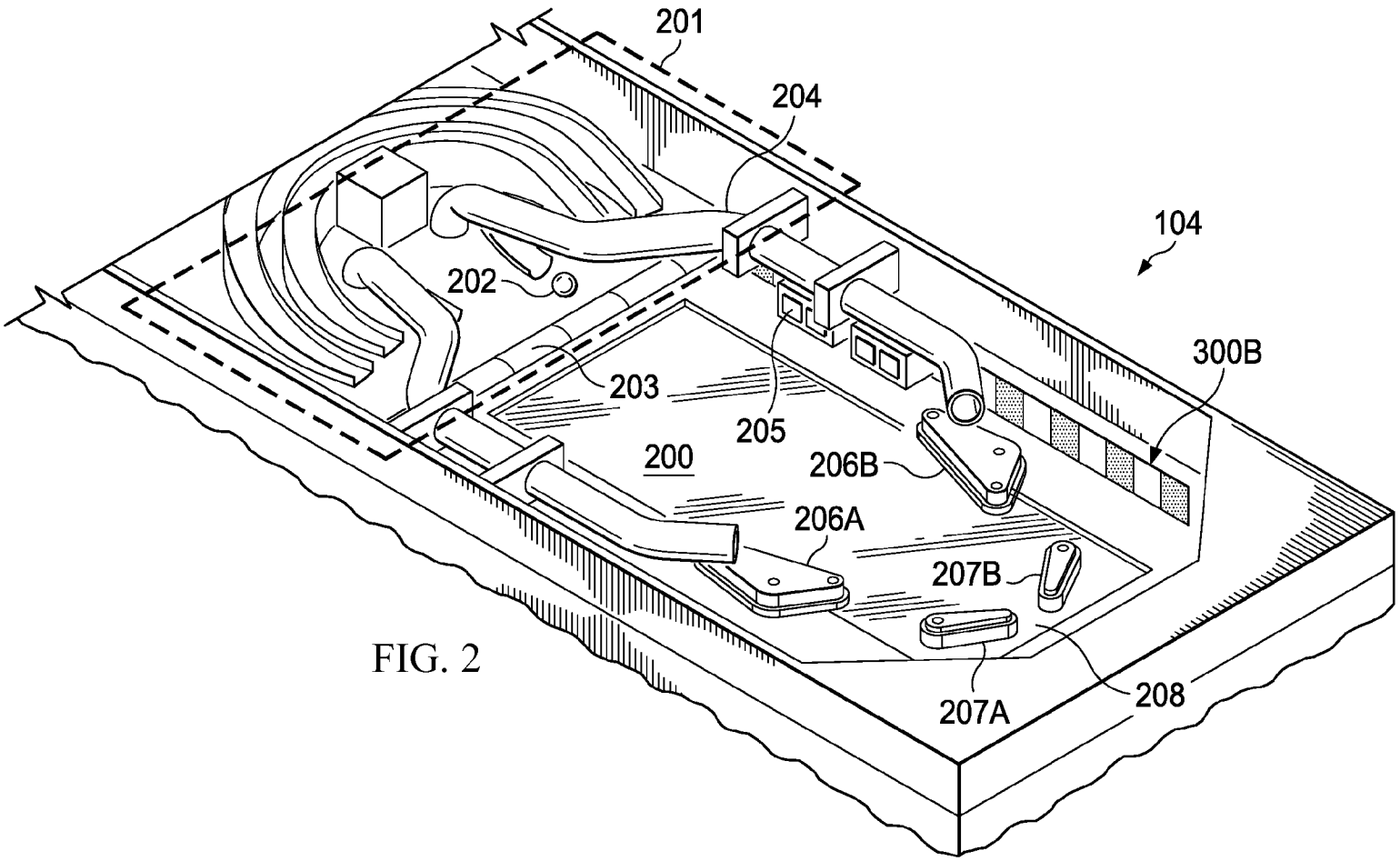
FIG. 2 is a three-dimensional, auxiliary view of an example of a hybrid playfield according to some embodiments.

FIG. 2 is a three-dimensional, auxiliary view of an example of hybrid playfield 104 according to some embodiments. Generally speaking, a "playfield" is a mostly flat surface over which one or more objects, such as ball 202, move in an amusement game, such as a pinball game. Hybrid playfield 104 is a playfield comprising a "physical space" and a "virtual space." The physical space may include one or more mechanical or electromechanical elements, also referred to herein as "physical objects." Electronic display 200 may provide the virtual space portion of hybrid playfield 104 by rendering one or more graphical elements referred to herein as "virtual objects."

In the case of a pinball machine, examples of hybrid playfield 104's physical objects include, but are not limited to, ball(s), plunger(s), bumper(s), kicker(s), bullseye target(s), drop target(s), variable point target(s), roll(s), saucer(s), spinner(s), rollover(s), switch(es), gate(s), stopper(s), ramp(s), toy(s), electromagnet(s), etc. Meanwhile, virtual objects may include any graphical or digital element that may be rendered on electronic display 200, such as, for example, artwork, colors, images, animations, photographs, designs, etc.

In various implementations, systems and methods described herein may allow certain physical objects to cause changes to certain virtual objects and/or vice-versa. Accordingly, these systems and methods may create an impression or an illusion upon a player that physical and virtual elements are interacting during a game, for example, in a physical or mechanical manner.

In the illustrated embodiment, hybrid playfield 104's physical objects include modular portion 201 configured to deploy one or more ball(s) 202 onto the playfield during a game. In this example, modular portion 201 includes barrier element(s) 203 and pipe element(s) 204. Barrier element(s) 203 may include one or more walls that can pop-up and at least partially block ball 202 from transiting between modular portion 201 and other portion(s) of hybrid playfield 104. In some cases, barrier element(s) 203 may act as a "trap" to cause ball 202 to fall under the surface of hybrid playfield 104 or become more or less static for a predetermined amount of time (e.g., by including an electromagnet or the like), for example. Meanwhile, pipe element(s) 204 may allow ball 202 to travel through predetermined paths or "shortcuts" when traveling within hybrid playfield 104.

Once deployed, ball 202 may tend to roll towards drain 208 depending upon the pitch of playfield 104 and absent action by a player operating flippers 207A and/or 207B. Flippers 207A and/or 207B are mechanically or electromechanically-controlled levers used for redirecting ball 202 up playfield 104, preventing ball 202 from falling into drain 208. Through the use of careful, skillful timing, a player may also be to manipulate flippers 207A and/or 207B to intentionally direct ball 202 in a selected direction with a given speed, thus causing ball 202 to hit various types of scoring targets, such as, for example, one or more trigger elements 205 and/or slingshots 206A and 206B.

With respect to hybrid playfield 104's virtual objects, electronic display 200 may be any suitable display or monitor (e.g., a Liquid Crystal Display (LCD) or the like) configured to present graphical designs and/or animations to a player. These virtual objects are configurable depending upon the design of a game, and may interact with certain physical objects in hybrid playfield 104. In some implementations, electronic display 200 may be capable of rendering 2D virtual objects on a flat screen. Additionally or alternatively, electronic display 200 may be capable of producing 3D and/or holographic virtual objects.

Although shown as a single display in FIG. 2, in other embodiments two or more electronic displays 200 may be disposed in playfield 104. For example, in some cases, a first electronic display and a second electronic display may be positioned side-by-side. In other cases, four electronic displays may be arranged such that each occupies a different quadrature of playfield 104. Furthermore, in some cases, electronic display 200 may be at least in part co-extensive with the surface of hybrid playfield 104.

As discussed in more detail below, ball 202 may cause one or more virtual objects rendered by electronic display 200 to appear, disappear, or change depending upon its position on hybrid playfield 104. Similarly, when ball 202 physically interacts with trigger element 205 and slingshots 206A and 206B, for example, one or more virtual objects presented on electronic display 200 may change their behavior in an appropriate manner. Conversely, virtual objects rendered on electronic display 200 may also behave in a way so as to cause a change in one or more of trigger element 205 and slingshots 206A and 206B, for example, thus appearing to a player as if a physical interaction between the virtual object and the physical object has taken place.

In some cases, in order to enable one or more of the foregoing operations, a tracking system may be disposed within machine 100 to determine a position of ball 202 and/or other physical objects. For instance, one or more arrays of infrared (IR) transducers may be disposed immediately above the surface of hybrid playfield 104 along one or more sides of electronic display 200.

Figure 3:
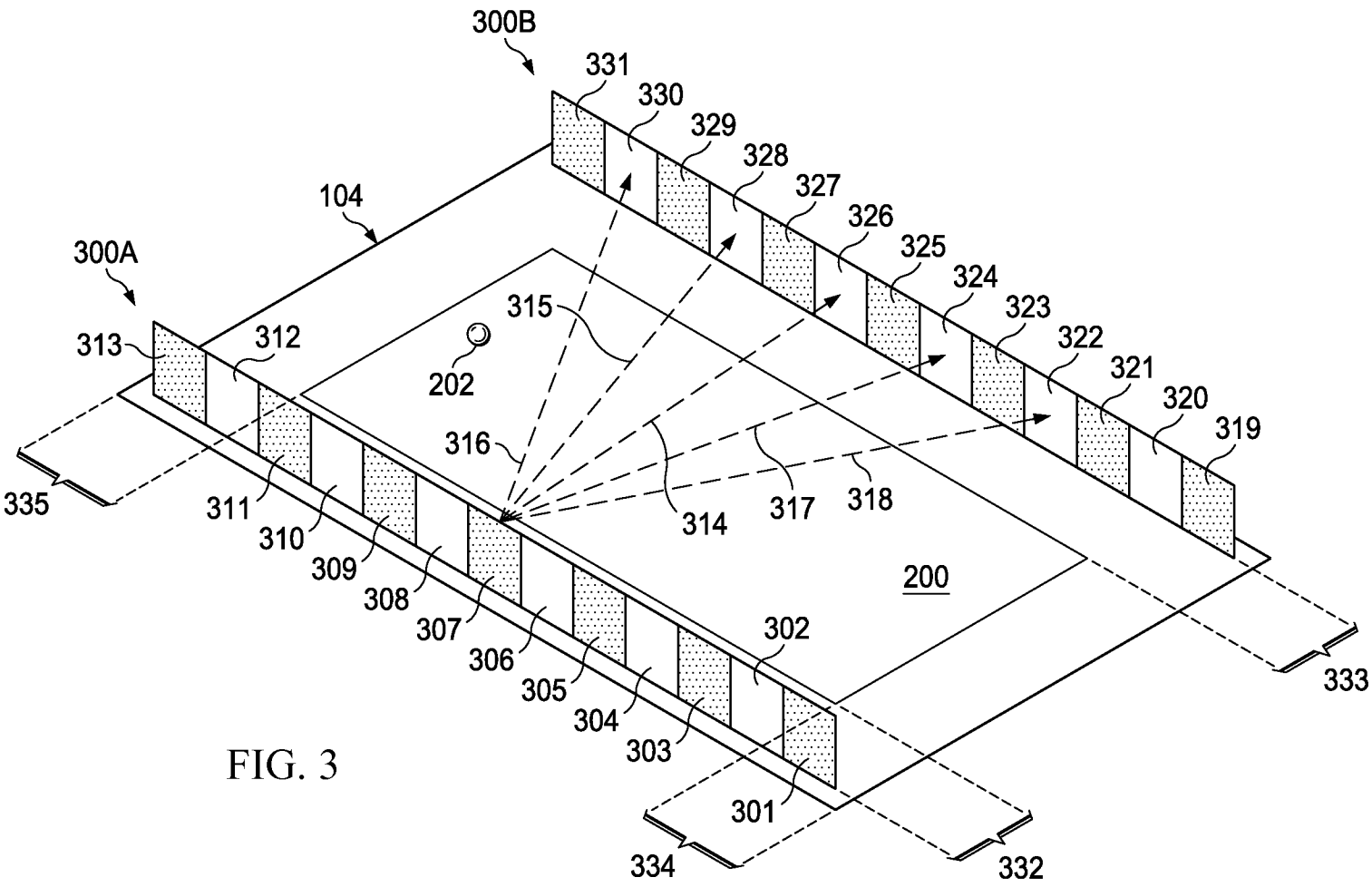
FIG. 3 is a three-dimensional, auxiliary view of an example of a tracking system in a hybrid playfield according to some embodiments.

Turning now to FIG. 3, a three-dimensional, auxiliary view of an example of tracking system 300 in hybrid playfield 104 is depicted according to some embodiments. As illustrated, tracking system 300 includes first IR transducer array 300A and second IR transducer array 300B. Arrays 300A and 300B are disposed immediately above the surface of playfield 104 on opposite sides of electronic display 200, and may be positioned such that other playfield components (e.g., trigger element 205, slingshots 206A and 206B, flippers 207A and 207B, etc.) do not interfere with its operations—that is, so that array 300A may have a least a partial direct line-of-sight with respect to array 300B. For instance, one or more of these playfield components may be "floating" with respect to electronic display 200 (e.g., attached or coupled to the top or cover of hybrid playfield 104).

In this example, arrays 300A and 300B are positioned at distances 332 and 333 from the sides of electronic display 200, and are longer than the height of electronic display 200 by lengths 334 and 335. In some implementations, distances and lengths 332-335 may be selected to avoid interfering with gameplay (i.e., without blocking ball 202's access to modular portion 201 or drain 208). Also, in cases where electronic display 200 extends to the edge of hybrid playfield 104, one or more of distances and lengths 332-335 may be zero and/or transducer arrays 300A and 300B may be positioned outside of hybrid playfield 104.

In this embodiment, IR transducer array 300A includes transmitter elements 301, 303, 305, 307, 309, 311, and 313 alternating with receiver or detector elements 302, 304, 306, 308, 310, and 312. Second IR transducer array 300B includes transmitter elements 319, 321, 323, 325, 327, 329, and 331 alternating with receiver or detector elements 320, 322, 324, 326, 328, and 330. It should be noted, however, that this particular configuration is provided for ease of explanation only, and that many other suitable configurations with a different number of arrays, transmitter elements, and detector elements may be used, sometimes in the same pinball machine 100. For instance, in other embodiments, tracking system 300 may include RF triangulation systems, video based motion tracking systems, capacitive systems, or other electro-mechanical position detection systems.

Figure 7:
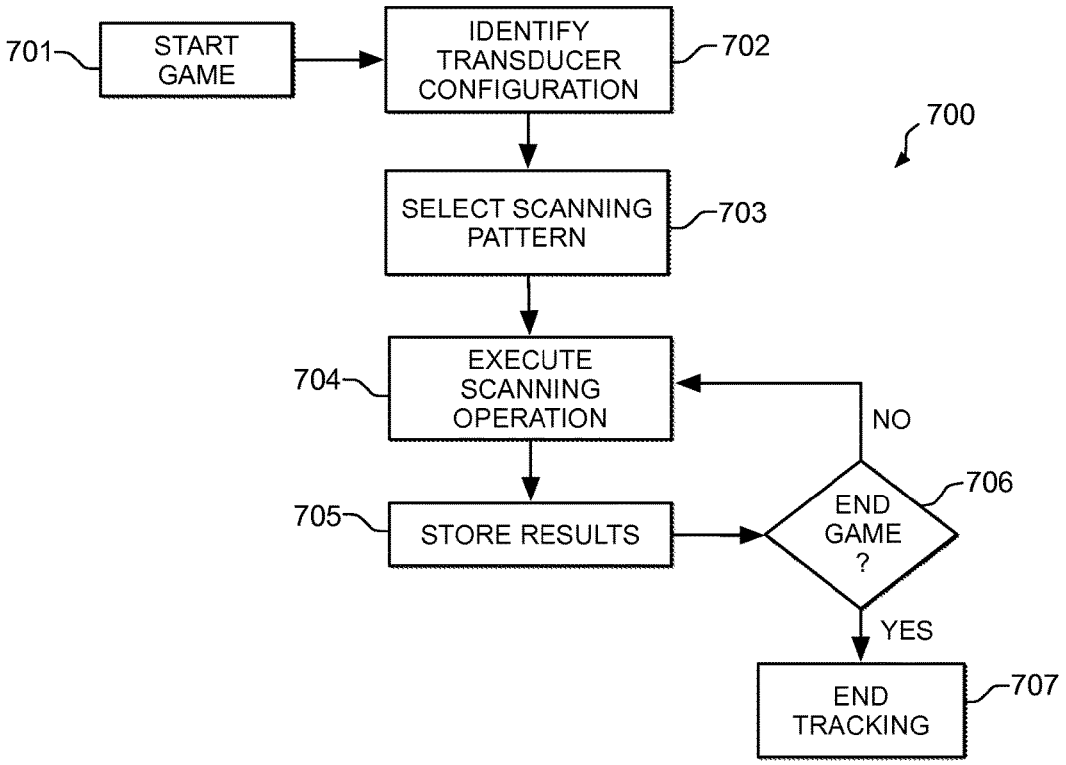
FIG. 7 is a flowchart of an example of a method of operating a tracking system in a hybrid playfield according to some embodiments.
Figure 8:
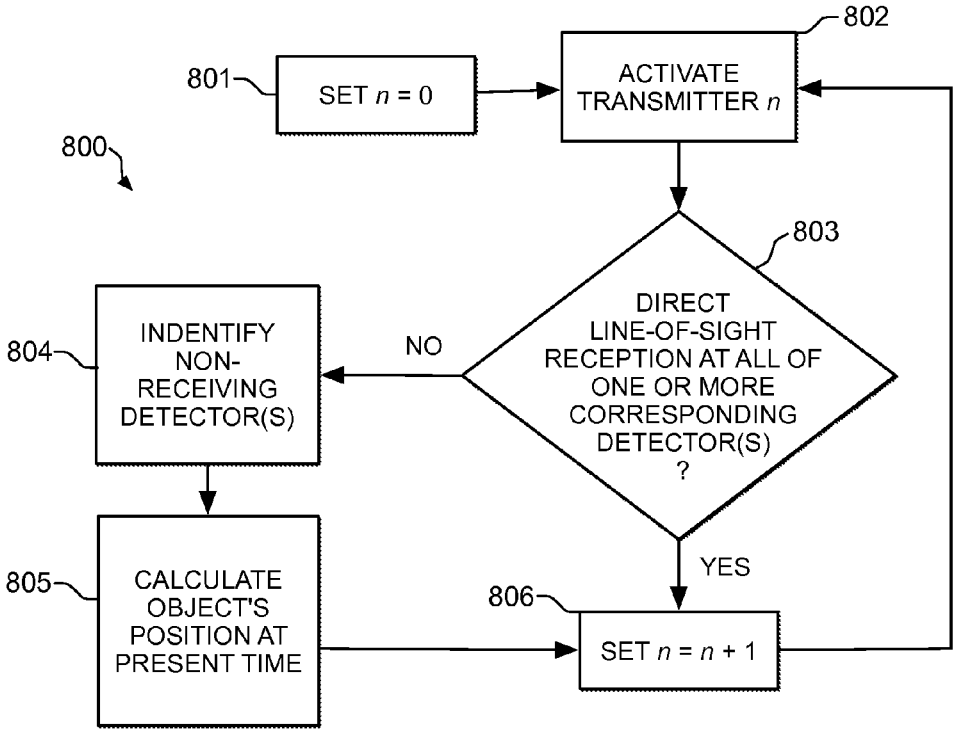
FIG. 8 is a flowchart of an example of a method of obtaining an object's position in a hybrid playfield using a tracking system according to some embodiments.

Tracking system 300 may be configured to scan hybrid playfield 104, for example, as explained in FIGS. 7 and 8. Briefly, each of transmitter elements 301, 303, 305, 307, 309, 311, and 313 of first array 300A may transmit IR signals in succession such that one or more of detector elements 320, 322, 324, 326, 328, and/or 330 of second array 300B receives these signals. Then, each of transmitter elements 319, 321, 323, 325, 327, 329, and 331 of second array 300B may transmit IR signals in succession such that one or more of detector elements 302, 304, 306, 308, 310, and/or 312 of first array 300A receives those signals. By determining which of detector elements 302, 304, 306, 308, 310, 312 320, 322, 324, 326, 328, and/or 330 were expected to receive their respective signals but did not, for example, because ball 202 was blocking that detector's line-of-sight, tracking system 300 may determine the position of ball 202 as it moves across hybrid playfield 104.

In some embodiments, tracking system 300 may be configured to determine the position, speed, and/or direction of movement of a physical object over hybrid playfield 104 with a margin of error no larger than the size of the physical object itself. Tracking system 300 may also be configured to determine the identification of a particular physical object, for example, when two balls 202 occupy hybrid playfield 104 simultaneously (e.g., via a chip or tag included in each ball 202, by maintaining a record of which ball gets deployed at what time and their respective trajectories, etc.). In some implementations, two or more tracking systems 300 may be used in the same hybrid playfield 104, and each of the two or more tracking systems 300 may be of a different type (e.g., an IR system and an RFID system, etc.).

Figure 4:
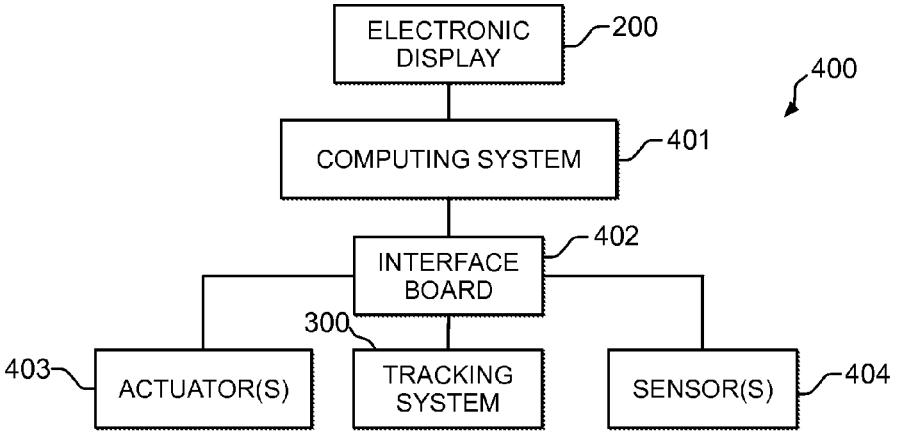
FIG. 4 is a block diagram of an example of hardware elements of a pinball machine with a hybrid playfield according to some embodiments.

FIG. 4 is a block diagram of an example of hardware elements 400 in pinball machine 100 with hybrid playfield 104 according to some embodiments. As shown, computing system or controller 401 is coupled to electronic display 200 of FIG. 2. Computing system 401 is also coupled to (or otherwise includes) interface board 402, which in turn is coupled to tracking system 300, actuator(s) 403, and/or sensor(s) 404.

In operation, computing system 401 may be configured to control electronic display 200 by providing one or more video signals capable of being rendered by electronic display 200 to create one or more 2D or 3D virtual objects in hybrid playfield 104 during a pinball game. Also, through interface board 402, computing system 401 may be configured to control the behavior of and/or to receive information related to physical objects in hybrid playfield 104 through interface board 402.

In some embodiments, interface board 402 may be any suitable pinball controller device such as, for example, the "Pinball—Remote Operations Controller" or "P-ROC" controller available from Multimorphic, Inc., which enables a computer to control a pinball machine over Universal Serial Bus (USB). It should be noted, however, that other pinball controller devices may be used as interface board 402, and that such a device may communicate with computing device 401 using any suitable bus and/or communication protocol.

In some cases, interface board 402 may be configured to control actuator(s) 403, such as, for example, coils, motors, etc. to thereby affect the behavior or status of physical elements, such as, for example, ball 202, barrier element 203, pipe element 204, trigger element 205, slingshots 206A and 206B, flippers 207A and 207B, or the like. Moreover, interface board 402 may be configured to receive information from sensor(s) 404 such as, for example, switches, optical sensors, etc., to determine the status of those physical objects. With regard to certain physical objects, such as, for example, ball 202, interface board 402 may also be configured to control tracking system 300 to obtain position and other information about those elements.

Figure 5:
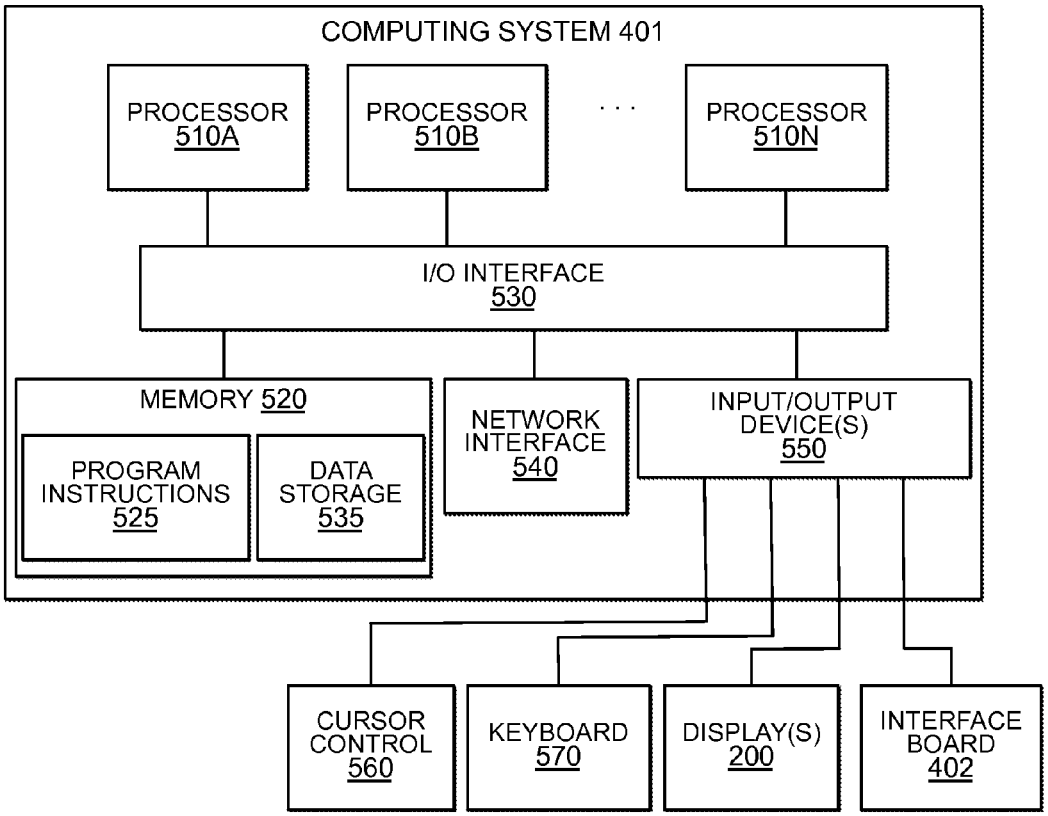
FIG. 5 is a block diagram of an example of a computing system or controller configured to implement aspects of a pinball machine with a hybrid playfield according to some embodiments.

FIG. 5 is a block diagram of an example of computing system 401 configured to implement aspects of pinball machine 100 with a hybrid playfield 104. In some embodiments, computing system 401 may be a server, a mainframe computer system, a workstation, a network computer, a desktop computer, a laptop, or the like. In other embodiments, one or more of the components described in connection with computing system 401 may be provided as a System-On-Chip (SoC), Application Specific Integrated Circuit (ASIC), or the like. More generally, however, computing system 401 may be any system, device, or circuitry capable of implementing or executing one or more of the various operations described herein.

In some implementations, computer system 401 may include one or more processors 510A-N coupled to a system memory 520 via an input/output (I/O) interface 530. Computing system 401 may further include a network interface 540 coupled to I/O interface 530, and one or more input/output devices 550, such as cursor control device 560, keyboard 570, electronic display(s) 200, and interface board 402.

In various embodiments, computing system 401 may be a single-processor system including one processor 510A, or a multi-processor system including two or more processors 510A-N (e.g., two, four, eight, or another suitable number). Processor(s) 510A-N may be any processor capable of executing program instructions. For example, in various embodiments, processor(s) 510A-N may be general-purpose or embedded processors implementing any of a variety of instruction set architectures (ISAs), such as the x86, POWERPC®, ARM®, SPARC®, or MIPS® ISAs, or any other suitable ISA. In multi-processor systems, each of processor(s) 510A-N may commonly, but not necessarily, implement the same ISA. Also, in some embodiments, at least one processor(s) 510A-N may be a graphics processing unit (GPU) or other dedicated graphics-rendering device.

System memory 520 may be configured to store program instructions and/or data accessible by processor(s) 510A-N. In various embodiments, system memory 520 may be implemented using any suitable memory technology, such as static random access memory (SRAM), synchronous dynamic RAM (SDRAM), nonvolatile/Flash-type memory, or any other type of memory. As illustrated, program instructions and data implementing certain operations, such as, for example, those described herein, may be stored within system memory 520 as program instructions 525 and data storage 535, respectively. In other embodiments, program instructions and/or data may be received, sent or stored upon different types of computer-accessible media or on similar media separate from system memory 520 or computing system 401. Generally speaking, a computer-accessible medium may include any tangible, non-transitory storage media or memory media such as magnetic or optical media—e.g., disk or CD/DVD-ROM coupled to computing system 401 via I/O interface 530.

The terms "tangible" and "non-transitory," are intended to describe a computer-readable storage medium (or "memory") excluding propagating electromagnetic signals, but are not intended to otherwise limit the type of physical computer-readable storage device that is encompassed by the phrase computer-readable medium or memory. For instance, the terms "non-transitory computer readable medium" or "tangible memory" are intended to encompass types of storage devices that do not necessarily store information permanently, including for example, random access memory (RAM). Program instructions and data stored on a tangible computer-accessible storage medium in non-transitory form may further be transmitted by transmission media or signals such as electrical, electromagnetic, or digital signals, which may be conveyed via a communication medium such as a network and/or a wireless link.

In an embodiment, I/O interface 530 may be configured to coordinate I/O traffic between processor 510, system memory 520, and any peripheral devices in the device, including network interface 540 or other peripheral interfaces, such as input/output devices 550. In some embodiments, I/O interface 530 may perform any necessary protocol, timing or other data transformations to convert data signals from one component (e.g., system memory 520) into a format suitable for use by another component (e.g., processor(s) 510A-N). In some embodiments, I/O interface 530 may include support for devices attached through various types of peripheral buses, such as a variant of the Peripheral Component Interconnect (PCI) bus standard or the Universal Serial Bus (USB) standard, for example. In some embodiments, the function of I/O interface 530 may be split into two or more separate components, such as a north bridge and a south bridge, for example. In addition, in some embodiments some or all of the functionality of I/O interface 530, such as an interface to system memory 520, may be incorporated directly into processor(s) 510A-N.

Network interface 540 may be configured to allow data to be exchanged between computing system 401 and other devices attached to network 115, such as other computer systems, or between nodes of computing system 401. In various embodiments, network interface 540 may support communication via wired or wireless general data networks, such as any suitable type of Ethernet network, for example; via telecommunications/telephony networks such as analog voice networks or digital fiber communications networks; via storage area networks such as Fiber Channel SANs, or via any other suitable type of network and/or protocol.

Input/output devices 550 may, in some embodiments, include one or more display terminals, keyboards, keypads, touch screens, scanning devices, voice or optical recognition devices, or any other devices suitable for entering or retrieving data by one or more computing system 401. Multiple input/output devices 550 may be present in computing system 401 or may be distributed on various nodes of computing system 401. In some embodiments, similar input/output devices may be separate from computing system 401 and may interact with one or more nodes of computing system 401 through a wired or wireless connection, such as over network interface 540.

As shown in FIG. 5, memory 520 may include program instructions 525, configured to implement certain embodiments described herein, and data storage 535, comprising various data accessible by program instructions 525. In an embodiment, program instructions 525 may include software elements of embodiments illustrated in FIG. 2. For example, program instructions 525 may be implemented in various embodiments using any desired programming language, scripting language, or combination of programming languages and/or scripting languages (e.g., C, C++, C#, JAVA®, JAVASCRIPT®, PERL®, etc.). Data storage 535 may include data that may be used in these embodiments. In other embodiments, other or different software elements and data may be included.

A person of ordinary skill in the art will appreciate that computing system 401 is merely illustrative and is not intended to limit the scope of the disclosure described herein. In particular, the computer system and devices may include any combination of hardware or software that can perform the indicated operations. In addition, the operations performed by the illustrated components may, in some embodiments, be performed by fewer components or distributed across additional components. Similarly, in other embodiments, the operations of some of the illustrated components may not be performed and/or other additional operations may be available. Accordingly, systems and methods described herein may be implemented or executed with other configurations.

Figure 6:
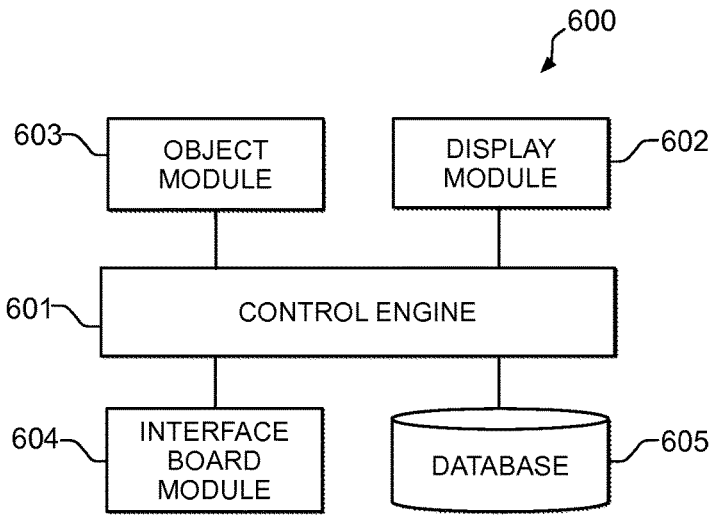
FIG. 6 is a block diagram of an example of a software program configured to implement aspects of a pinball machine with a hybrid playfield according to some embodiments.

FIG. 6 is a block diagram of an example of software program 600 configured to implement aspects of pinball machine 100 with a hybrid playfield 104. In some embodiments software 600 may be executed by computing system 401 described above. For example, in some cases, software program 600 may be implemented as program instructions 525 of FIG. 5. Generally speaking, control engine 601 may include one or more routines configured to implement one or more of the various techniques described herein. For instance, control engine 601 may include one or more routines configured to allow a user to select a game stored in database 605. Control engine 601 may also include one or more routines configured to allow a user to start or terminate a game, as well as one or more routines configured to manage progress of a game.

Display module 602 may provide a software interface between computing device 401 and electronic display 200 such that images produced by display module 602 are rendered in electronic display 200 under control of control engine 401. Interface board module 604 may provide a software interface between computing device 401 and interface board 402. Through interface board module 402, control engine 401 may determine that one or more sensor(s) 404 have been activated and/or it may control, via actuator(s) 403, a physical aspect of a physical object in hybrid playfield 104. Control engine 401 may also receive tracking information from tracking system 300 via interface board module 402.

Object module 603 may keep track of one or more graphical elements or virtual objects being displayed (or yet to be displayed) on electronic display 200 via display module 602, including, for example, a virtual object's characteristics such as the object's identification, boundaries, shape, color, size, texture, position (on electronic display 200), speed, direction of movement, etc. Object module 603 may also keep a record of the received tracking information for one or more physical objects including, for example, an identification of the physical object, its position (above electronic display 200), speed, direction of movement, shape, etc.

In some embodiments, the modules or blocks shown in FIG. 6 may represent processing circuitry and/or sets of software routines, logic functions, and/or data structures that, when executed by the processing circuitry, perform specified operations. Although these modules are shown as distinct logical blocks, in other embodiments at least some of the operations performed by these modules may be combined in to fewer blocks. For example, in some cases, object module 603 may be combined with display module 602 and/or with interface board module 604. Conversely, any given one of modules 601-605 may be implemented such that its operations are divided among two or more logical blocks. Although shown with a particular configuration, in other embodiments these various modules or blocks may be rearranged in other suitable ways.

FIG. 7 is a flowchart of an example of method 700 of operating tracking system 300 in hybrid playfield 104. In some embodiments, method 700 may be performed, at least in part, by computing system 401 executing software 600 in cooperation with interface board 402 and tracking system 300. At block 701, method 700 may include determining that a pinball game has started or is about to start. At block 702, method 700 may include identifying a transducer configuration to be used by tracking system 300. As previously noted, different transducer configurations may be used in a single machine 100, and, depending upon the specific game being played, a particular configuration may be more suitable for tracking certain physical objects.

At block 703, method 700 may include selecting a scanning pattern to be used during a tracking operation. For example, in the configuration shown in FIG. 3, the selected scanning pattern assigns detector elements 322, 324, 326, 328, and 330 to receive signals 318, 317, 314, 315, and 316 emitted by transmitter element 307, respectively. In some cases, a scanning pattern may be such that each of transmitter elements 301, 303, 305, 307, 309, 311, 313, 319, 321, 323, 325, 327, 329, and 331 is activated in rapid succession and in this order. In other cases, a transmitter element of first transducer array 300A may be activated followed by a transmitter element of second transducer array 300B in an alternating manner (e.g., 301, 319, 303, 321, and so on). In yet other cases, two or more transmitter elements may be activated simultaneously.

In some implementations, more or fewer detectors may be assigned to receive more or fewer signals from a given transmitter element at a given time. Moreover, the position of the transmitter element may dictate how many and which detector elements are assigned for a given scanning pattern. For instance, using the pattern illustrated in FIG. 3, when transmitter 301 is active, only detectors 320 and 322 (i.e., two detectors) may be configured to receive its signals. When transmitter 303 is active, detectors 320, 322, 324, and 326 (i.e., four detectors) may be configured to receive its signals. And, when transmitter 305 is active, detectors 320, 322, 324, 326, and 328 (i.e., five detectors) may be configured to receive its signals. In other implementations, however, a 1:1 relationship between transducer elements may be established such that a given detector is assigned to a single corresponding transmitter and vice-versa.

More generally, any suitable scanning pattern may be selected that creates a mesh such that, when a physical object such as ball 202 is traveling between transducer arrays 300A and 300B therefore blocking the line-of-sight between a transmitter and an assigned detector, tracking system 300 and/or computing system 401 is capable of determining the position, speed, and/or direction of movement of the physical object. In various embodiments, signals are transmitted and received between transducer arrays 300A and 300B at angles other than a right angle.

At block 704, method 700 may execute scanning operation(s) using the identified configuration and/or selected pattern and, at block 705, method 700 may store results of those operation(s). At block 706, method 700 may determine whether the game has ended. If not, control returns to block 704. Otherwise, tracking may end at block 707.

It should be noted that, in some embodiments, one or more of the operations described above may be conducted independently of whether a game is in progress. For example, in some cases, tracking may be active for purposes of touchscreen interactions when pinball machine 100 is in "service mode" (e.g., testing, debugging, etc.). More generally, electronic display 200 in conjunction with tracking system 300 may allow an operator to interface with aspects of computing system 401 at any time, for instance, to change the machine's configuration, select a new pinball game, test one or more of the machine's components, etc.

FIG. 8 is a flowchart of an example of method 800 of obtaining an object's position in hybrid playfield 104 using tracking system 300 according to some embodiments. Again, in some embodiments, method 800 may be performed, at least in part, by computing system 401 executing software 600 in cooperation with interface board 402 and tracking system 300. At block 801, method 800 may include initializing or setting an integer or counter n to a zero value and, at block 802, method 800 may include activating transmitter element n.

At block 803, method 800 may include determining whether there is a direct line-of-sight reception at all of the one or more assigned detector elements. If so, then block 806 increments the value of n and control returns to block 802, where a subsequent transmitter element following the selected scanning pattern is selected. Otherwise, at block 804, method 800 may include identifying which of the assigned detector elements had its light-of-sight blocked by a physical object. Then, at block 805, method 800 may include calculating the physical object's position based, at least in part, upon the result of block 804.

To illustrate operations 802-806, consider the following example. Assume, hypothetically, that ball 202 shown in FIG. 3 is now at a position such that it blocks the light-of-sight of detector 330 when transmitter 307 is activated. Because the relative position between arrays 300A and 300B is known, it may be inferred that, at the time of the scan, ball 202 was located somewhere along the path of signal 316. As n is incremented, subsequent transmitter elements are activated and other detectors may have their light-of-sight blocked, such that the position of ball 202 may be determined to be at the intersection(s) of two or more of these signals.

In some embodiments, the frequency of the scanning operation may be such that a sufficient number of transmitters are activated in series to resolve the position of ball 202 prior to ball 202 having moved to another position that is significantly distant from the resolved position. For example, in some cases, the position of ball 202 may be identified with a margin of error no larger than the diameter of ball 202.

Computing system 401, interface board 402, and/or object module 403 may also maintain a historical record of the positions of ball 202 at different times. Therefore, computing system 401 and/or interface board 402 may be configured to calculate a speed of ball 202 and/or a direction of movement of ball 202 based on that historical record. In some cases, computing system 401 and/or interface board 402 may be further configured to predict the position of ball 202 at a future time based upon its present and/or past behavior.

Physical Objects Causing Changes in Virtual Objects

In some embodiments, hybrid playfield 104 may provide the illusion that one or more physical objects, such as one or more balls 202, interact with one or more virtual objects, such as one or more images rendered on electronic display 200. This may take place, for example, when a physical object is detected via tracking system 300 to be moving over an area of hybrid playfield 104 containing the virtual objects. In other examples, the interaction with virtual objects may be triggered upon detection, via tracking system 300, that a physical object has a certain speed or moves in a particular direction (e.g., toward a virtual object) across hybrid playfield 104.

In some cases, interactions between a physical object and a first virtual object may cause that first virtual object to move, change its shape, disappear, etc. on electronic display 200. The same interactions between the physical object and the first virtual object may also cause a second virtual object to move, change its shape, appear, disappear, etc. on electronic display 200. Other game-related interactions resulting from the interaction of physical and virtual objects in hybrid playfield 104 may include, but are not limited to, game scores being adjusted, sound and video devices being played, lamps being turned on and off individually or in pre-defined sequences, etc.

Figure 9:
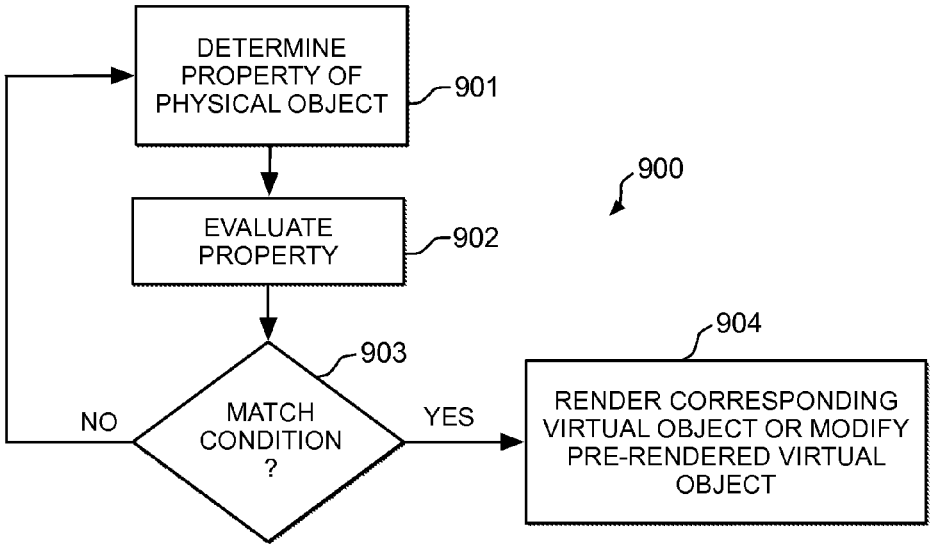
FIG. 9 is a flowchart of an example of a method of enabling physical object(s) to interact with virtual object(s) in a hybrid playfield according to some embodiments.

FIG. 9 is a flowchart of an example of a method of enabling physical object(s) to interact with virtual object(s) in hybrid playfield 104. In some embodiments, method 900 may be performed, at least in part, by computing system 401 executing software 600 in cooperation with electronic display 200, interface board 402, and tracking system 300. At block 901, method 900 may include determining a property of a physical object (e.g., ball 202). For instance, in some cases, method 900 may include determining a position of the physical object on hybrid playfield 104, a speed of the physical object over hybrid playfield 104, and/or a direction of movement of the physical object across hybrid playfield 104.

At block 902, method 900 may evaluate the property. At block 903, if the property does not match any preselected conditions, control returns to block 901. Otherwise, control passes to block 904, where method 900 may include rendering a corresponding virtual object on display 200 or modifying a previously rendered virtual object. The conditions referred to in block 903 may include any programmable statement(s) that, when executed, give the appearance that the physical object's property or behavior has affected one or more virtual objects.

In some implementations, a player may indirectly manipulate the physical object described in block 901. For example, when the physical object is ball 202, the player may briefly hit that object with another physical object, such as flippers 207A and 207B. Manipulation of flippers 207A and 207B may itself be indirect, for example, via side control(s) 107. After being hit, ball 202 may travel along playfield freely and outside of the user's control.

It should be noted that determination of a property of a physical object in block 901 is different from the detection of a player's own finger or stylus on a capacitive touchscreen of a tablet computer, which the user directly controls. For example, in the tablet scenario, if the touchscreen does not respond as expected by the user, the user may simply repeat his or her gesture; whereas in the case of a pinball machine, because ball 202 moves on its own, it would be much more difficult to make ball 202 repeat the exact same trajectory at a later time and, in any event, a game opportunity would be lost.

Figure 10A:
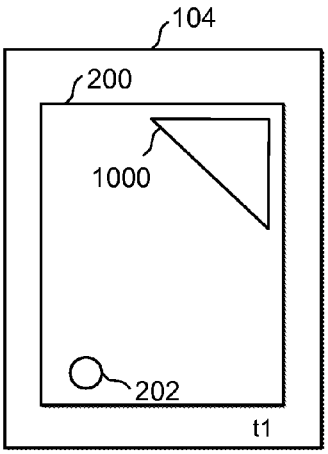
FIGS. 10A-H are diagrams illustrating examples of physical object(s) initiating interaction(s) with virtual object(s) according to some embodiments.
Figure 10B:
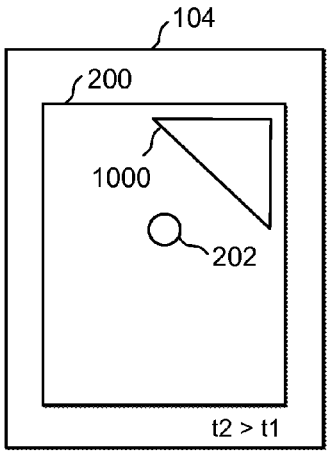
Figure 10C:
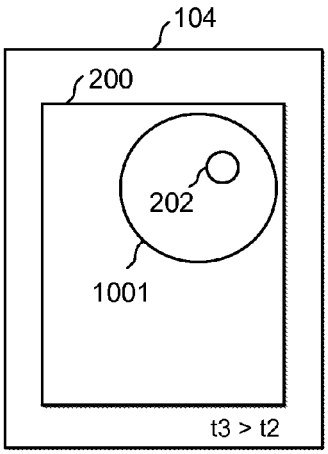

FIGS. 10A-H are diagrams illustrating examples of physical object(s) initiating interaction(s) with virtual object(s) according to some embodiments. Particularly, FIG. 10A shows ball 202 (i.e., a physical object) at t=t1 traveling along hybrid playfield 104 while electronic display 200 renders virtual object 1000 in the shape of a triangle. At FIG. 10B, ball 202 has moved closer to virtual object 1000 at t=t2 (t2>t1), but has not yet reached it. Then, at FIG. 10C, ball 202 has reached the position of virtual object 1000 on electronic display 200 at t=t3 (t3>t2), thus causing virtual element 1000 to change into virtual element 1001, which now has a circular shape. Referring back to FIG. 9, the predetermined condition expressed in block 903 in this case may be such as:

```
if position of <ball 202> == position of <virtual object 1000>;
    then change <virtual object 1000> into <virtual object 1001>
```

Thus, in this case, the operations of method 900 may help create a visual impression that ball 202 has physically interacted with virtual object 1000 upon reaching its location in hybrid playfield 104 and effectively changed the virtual object's shape and/or other visual characteristic.

Figure 10D:
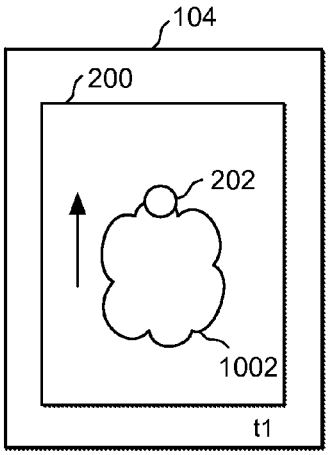
Figure 10E:
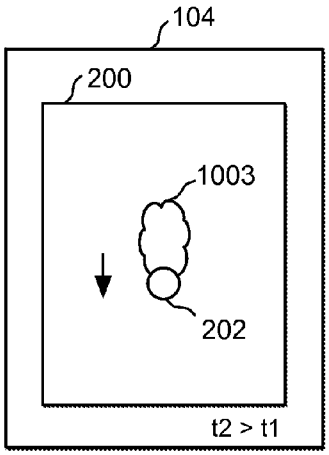

As another example, FIG. 10D illustrates ball 202 traveling upwards (shown by an arrow pointing up) across hybrid playfield 104 at t=t1 (e.g., after being hit by flipper(s) 207A or 207B), thus acquiring a first speed. FIG. 10E shows ball 202 traveling in a downwards direction (shown by an arrow pointing down) at t=t2 (t2>t1) with a second speed which, in this case, is smaller than the first speed. Accordingly, in FIG. 10D, virtual object 1002 represents a graphical image or visual animation of fire or smoke following ball 202 and having a first size proportional to the first speed, whereas in FIG. 10E virtual object 1003 represents the fire or smoke with a second size proportional to the second speed, such that the first size is larger than the second size.

Figure 10F:
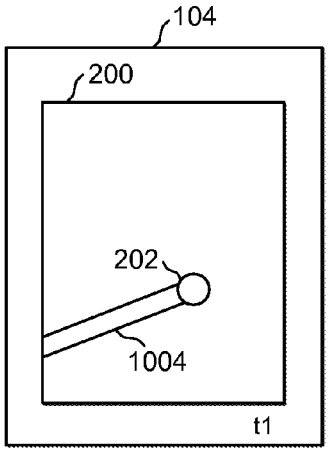
Figure 10G:
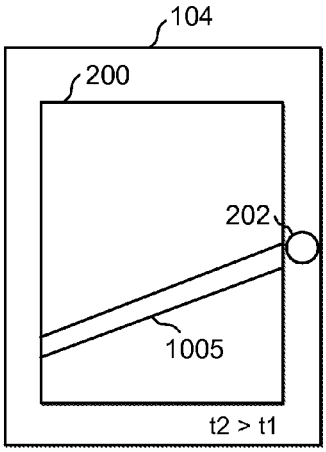
Figure 10H:
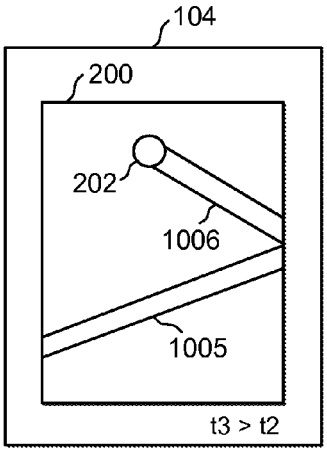

As yet another example, FIG. 10F shows ball 202 traveling across hybrid playfield 104 at t=t1 in a first direction thus leaving trail or mark 1004. FIG. 10G shows ball 202 leaving the surface of electronic display 200 and reaching the boundary of hybrid playfield 104 at t=t2 (t2>t1), from which ball 202 bounces back. As such, trail or mark 1005 is longer than trail or mark 1004. Then, FIG. 10H shows ball 202 traveling across hybrid playfield 104 in a second direction at t=t3 (t3>t2), thus creating trail or 1006 in the second direction.

It should be noted that the examples of FIGS. 10A-H are provided for sake of illustration. More generally, any virtual object(s) rendered on electronic display 200 may be affected by any physical property (or combination of physical properties) of any physical object(s) within hybrid playfield 104 in any suitable manner. In the examples above, the physical properties used are position, speed, and direction; although in other embodiments, other physical properties may be used such as shape, size, sound, color, etc. In various implementations, the type of virtual object and how that object is affected by the behavior of a physical object normally depends upon the specific game being played, and as such may vary from game to game.

Moreover, in some embodiments, the behavior of a physical object may be detected other than through tracking system 300. For instance, ball 202 may physically reach trigger element 205, and electronic display 200 may in response render an animation such that it appears that a first virtual object such as an image of a laser beam or projectile is shot by trigger element 205 into hybrid playfield 104. The first virtual object may then interact with other virtual objects on electronic display 200; for example, the virtual laser beam or projectile may cause a second virtual object (e.g., an image of a building, etc.) to explode on electronic display 200.

Virtual Objects Causing Changes in Physical Objects

In some embodiments, hybrid playfield 104 may present the illusion that one or more virtual objects, such as one or more images rendered on electronic display 200, interact with one or more physical objects, for example, when the virtual object exhibits a predetermined behavior. For instance, when a virtual element is animated on display 200 in a particular way, it may trigger a software-initiated modification to an aspect of a physical object.

Figure 11:
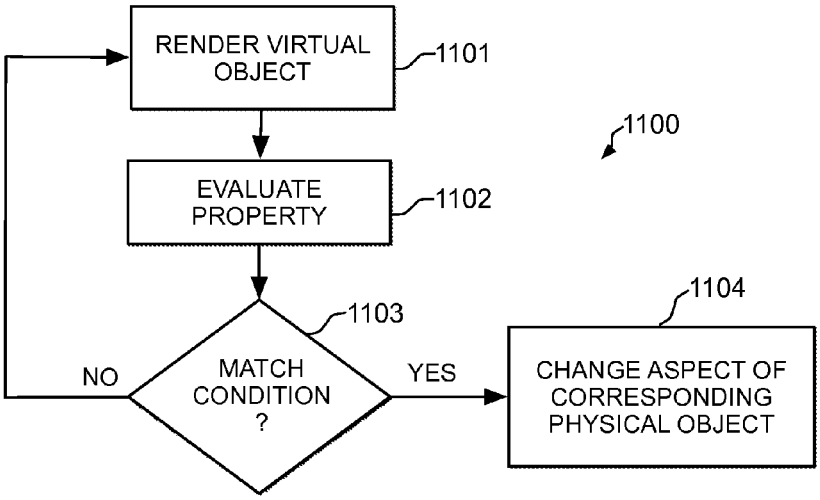
FIG. 11 is a flowchart of an example of a method of enabling virtual object(s) to interact with physical object(s) in a hybrid playfield according to some embodiments.

In that regard, FIG. 11 is a flowchart of an example of a method of enabling virtual object(s) to interact with physical object(s) in hybrid playfield 104. In some implementations, method 1100 may be performed, at least in part, by computing system 401 executing software 600 in cooperation with electronic display 200, interface board 402, and tracking system 300. At block 1101, method 1100 may include rendering a virtual object on electronic display 200. At block 1102, method 1100 may include evaluating a property of the virtual object. At block 1103, if the property does not match a programmed condition, control returns to block 1101. Otherwise, at block 1104, method 1100 may include changing an aspect of a corresponding physical object.

Figure 12A:
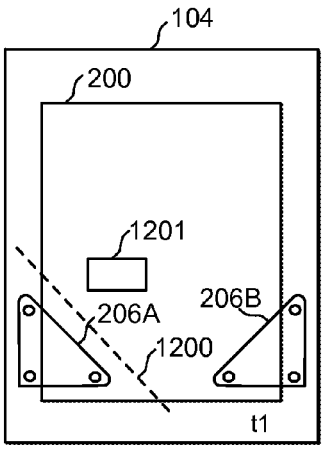
FIGS. 12A-F are diagrams illustrating examples of virtual object(s) initiating interaction(s) with physical object(s) according to some embodiments.
Figure 12B:
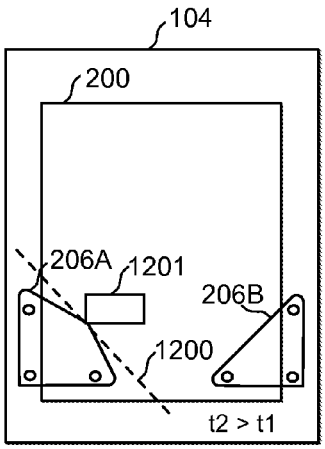
Figure 12C:
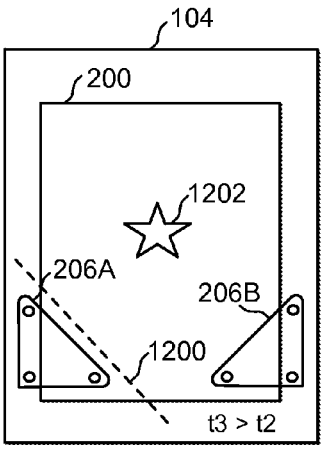

FIGS. 12A-F are diagrams illustrating examples of virtual object(s) initiating interaction(s) with physical object(s) according to some embodiments. In FIG. 12A, virtual object 1201 is animated on display 200 to move at t=t1 toward slingshot 206A, a physical object. FIG. 12B shows virtual object 1201 reaching threshold line 1200 at t=t2 (t2>t1), thus triggering a deformation of slingshot 206A such that, to an observer, it appears as if slingshot 206A is reacting physically to the behavior of virtual object 1201 on display 200. The deformation of slingshot 206A is a physical response initiated by software because, in this case, virtual object 1201 is in a specific position relative to slingshot 206A. In an embodiment, the shape of slingshot 206A may be controlled by a solenoid mechanism that, when activated by software, pushes against a side of slingshot 206A, thus causing it to mechanically expand. Then, FIG. 12C shows slingshot 206A returning to its original shape at t=t3 (t3>t2), and electronic display 200 changes the shape of virtual element 1201 into virtual element 1202, which now travels away from slingshot 206A on display 200 as if it had physically bounced off of slingshot 206A and now appears to be moving further away from slingshot 206A.

By drawing virtual element 1202 such that it appears to be moving away from slingshot 206A, this technique may cause observer, such as the player, to believe that a virtual element 1201 (i.e., a graphical image) actually represents a physical object that interacted mechanically or physically with another (but actual) physical object (i.e., slingshot 206A). More specifically, it may appear as if virtual element 1201 actually collided with slingshot 206A, causing a solenoid mechanism to activate, in turn causing slingshot 206A to "push" virtual element 1202 away from it.

Figure 12D:
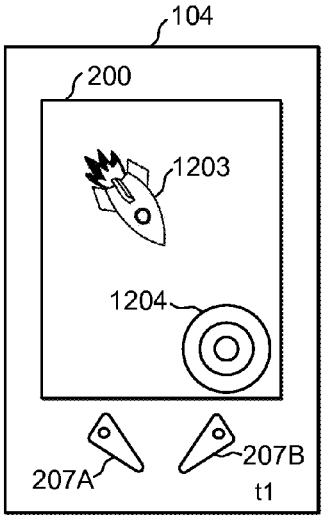
Figure 12E:
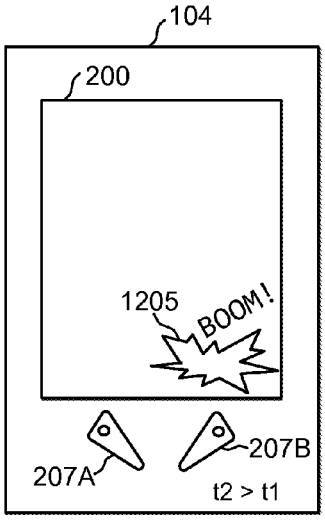
Figure 12F:
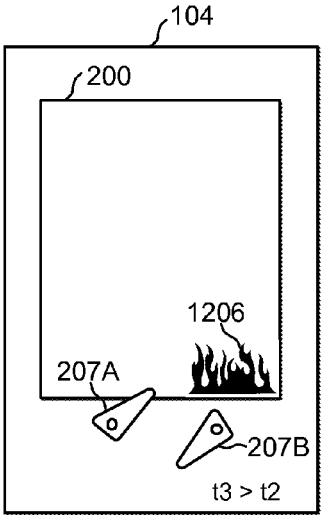

In other embodiments, a virtual element does not need to appear to come into contact with a physical object, but it may still affect the operation of that physical object. An example of this technique is shown in FIGS. 12D-E. In FIG. 12D, a first virtual object 1203 (a rendering of a missile) is animated to move toward a second virtual element 1204 (a rendering of a target) on electronic display 200 at t=t1. FIG. 12E shows that first virtual object 1203 and second virtual object 1204 have been replaced by third virtual object 1205 (a rendering of an explosion) upon first virtual object 1203's reaching of second virtual object 1204 at t=t2 (t2>t1). At this moment, operation of flipper 207B (i.e., a physical object) may be changed such that, when a player activates side control(s) 107, only flipper 207A is capable of moving upwards while flipper 207B is stuck in a down position as a result of the collision between virtual element 1203 and virtual element 1204. In some cases, a fourth virtual object 1206 (e.g., a rendering of fire or smoke) may indicate that flipper 207B is not operational such that, when virtual object 1206 disappears of fades from electronic display 200, flipper 207B returns to its normal operation under control of the player.

In other words, when the first virtual object reaches a specific point on electronic display 200, it may cause a specific, predetermined reaction in a physical object, such as one or more flippers 207A and 207B. An example of such a reaction may be to cause the one or more of flippers 207A and 207B to flip, as if the missile pressed a "virtual flipper" button. Another reaction may be causing flippers 207A and 207B to "lose power," such that when the player next activates the flippers, they do not have as strong a pulse as they did prior to the missile reaching the specific location on electronic display 200. Because the length of the flipper pulse, and therefore the power of the pulse, is controlled by software, control engine 601 may effectively weaken flippers 207A and/or 207B in response to missile 1203 reaching the specific location on the electronic display 200. This technique may make it appear that the graphical, virtual object (i.e., missile 1203) represented a physical element, such as a real missile, and was therefore capable of affecting physical object (i.e., flippers 207A and 207B).

Similarly as explained above, here it should also be noted that the examples of FIGS. 12A-F are provided for sake of illustration. More generally, any physical object(s) in hybrid playfield 104 may have its propert(ies) modified in response to the behavior of one or more virtual object(s). Properties of the physical objects that may be subject to being changed include its shape, operation, color, sound, etc. Again, in various implementations, the type of physical object and how that object is affected by the behavior of a virtual object normally depends upon the specific game being played, and as such may vary from game to game.

Physical objects that can be affected by virtual objects include, but are not limited to, lamps, light emitting diodes (LEDs), magnets, motors, and solenoid assemblies, all of which may be found on pinball machine 100. Virtual objects that may interact with physical objects include, but are not limited to, shapes or combination of shapes drawn on a display element, projected from a projection device, or otherwise displayed in a way that they appear to be part of or on pinball machine 100. The location of virtual objects can be anywhere on machine 100, oftentimes, but not always, close to the physical objects with which they appear to interact. In the example above where the missile is described to press a virtual flipper button, the spatial proximity of the missile and virtual button relative to the flippers is not relevant. As such, the graphical elements (missile and virtual button) can be located anywhere on electronic display 200.

Providing Multiple-Game Pinball Machines

In some embodiments, pinball machines 100 such as described in FIG. 1 may be configured to load, store, and/or run multiple software applications. A software application may, upon execution, present a player with a full gaming experience on machine 100. Such a gaming experience is commonly referred to as a "pinball game" or simply "game." Each game may include program instructions and/or logic that causes it to: start running at a player's request, launch one or more balls into play, and enable the player's interaction with the ball (e.g., by allowing the player to control the flippers, and present play objectives to the players). Play objectives may include goals that the player may attempt to achieve during the course of gameplay, including, but not limited to, hitting specific targets or shots, sometimes in specific sequences.

Each game may have a defined beginning and end. The beginning of a game usually includes the resetting of specific game objects and objectives and launching a ball into play. The ball may be launched into play either automatically when the game begins, or in response to an action by the player, such as the pressing of a button. The end of a game may include the conclusion of a set of gameplay objectives. This conclusion may occur either when the player successfully achieves the objectives or when the player's last ball goes out of play, either by draining or by some other event on the pinball machine. The end of a game may also include information presented to the player about the accomplishments that were achieved during gameplay and/or about other information indicating the game has ended. In some cases, the information may be presented as audio and/or video and/or even as tactile feedback provided through mechanisms on the machine.

As previously noted, pinball machine 100 may comprise computing device 401, which in turn includes static or dynamic computer memory, typically a non-volatile flash-based device or a computer hard drive, onto which multiple software applications may be loaded and/or stored. Generally speaking, there is no limit to the number of software applications that may be loaded and/or stored other than those imposed by the physical size of the storage devices used for software application storage.

In another embodiment, pinball machine 100 may be capable of connecting to a computer network over which software applications may be loaded, stored, and/or played. Therefore, software applications available on the network, whether on a remote software application server or on another pinball machine on the network, may be loaded and stored so that they can be played immediately or at some time in the future, whether or not the pinball machine remains connected to the network. Alternatively, a software application may be run directly from the network, whereby the software application is not stored locally but rather loaded and run while the pinball machine stays connected to the network. In this case, the software application may not be stored on the pinball machine and therefore would be unavailable when the machine is not connected to the network.

In yet another embodiment, the pinball machine may be capable of running a game directly from locally attached media, such as a CD or DVD. In this embodiment, a user can load one media device, such as a CD or DVD, to play one software application and later load another media device, such as another CD or a DVD, to play another software application. Alternatively, one media element, such as a CD or DVD, may contain multiple software applications from which the player can choose which one to load and play.

Pinball machine 100 may also include a software Operating System (OS) that presents the user with a way to select the desired software application. In an embodiment, the operating system, which is a layer of software that is running when no software application is active and oftentimes even while a software application is active, shows a set of choices on a display (e.g., electronic display 200). Each choice may include a menu of additional choices or the name of available software applications. The OS may provide the user with a suitable way of navigating through the choices, oftentimes via button presses, and selecting desired items, such as additional menus to be navigated or the software application to be executed. The OS may therefore provide a way for the user to select a software application to play.

As described before, a list of software applications may include software applications already stored locally on the machine and/or software applications that are available from remote devices accessible via a computer network to which the pinball machine is connected and/or software applications stored on media devices, such as CDs, DVDs, or any other type of media capable of storing one or more software applications.

The OS may also provide ways of loading and storing additional software applications. In an embodiment, the OS may provide a set of options the user can select via buttons. One such option may be to load a list of available software applications from the network. The OS may then allow a user to select one or more of the available software applications, and the OS may load the desired software applications from the network and store them locally. In another embodiment, the OS may provide one or more mechanisms to load additional software applications from locally attached media, such as a CD or DVD, or from some other locally attached device, such as a computer or storage device attached through USB, BLUETOOTH, or some other communications interface.

Embodiments of pinball machine 100, as described above, may present the user with a list of software applications. The presentation of the list may take many forms, including but not limit to menus, folders, a single long list, and/or graphical icons or screens. The user may select and play the same software application every time he wants to play a game, or he can select and play a different software application each time.

In multi-player games, whereby software tracks the gameplay of multiple players simultaneously or sequentially, each player may optionally choose the same software application as those chosen by other players or a completely different software application. In this manner, multiple players may play different software applications at the same time on the same machine. In some embodiments this may involve each player taking turns playing until one specific portion of their game ends, such as a ball draining, while in other embodiments, players may be physically interacting with the machine and playing their chosen software applications simultaneously.

When including one or more of the elements described above, pinball machine 100 may be considered to be a pinball platform, whereby the platform is capable of loading and/or storing and/or executing many different software applications. The software applications may all be related to a specific theme or subject matter, or they may each be completely different and unique. Because the number of software applications the pinball machine stores and/or executes may continue to grow over time, it is significantly less likely, as compared to a traditional pinball machine that presents just one or two different software applications to a player, to become boring to the player.

Figure 13:
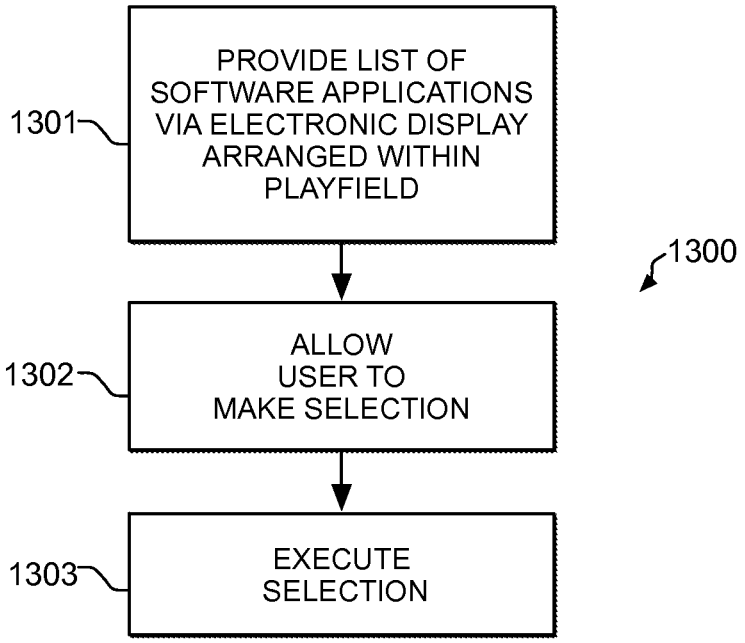
FIG. 13 is a flowchart of an example of a method of providing one or more software applications in a pinball machine according to some embodiments.

FIG. 13 is a flowchart of an example of method 1300 of providing one or more software applications in pinball machine 100 according to some embodiments. At block 1301, method 1300 includes providing a list of software applications (e.g., pinball games) via a display or screen (e.g., electronic display 200) arranged within a playfield (e.g., hybrid playfield 104). At block 1302, method 1300 may include allowing a player or user to make a software selection (e.g., using side control(s) 107). Then, at block 1303, method 1300 may include executing the software selection (e.g., starting a selected game).

It should be understood that the various operations described herein, particularly in connection with FIGS. 7-13, may be implemented in software executed by processing circuitry, hardware, or a combination thereof. The order in which each operation of a given method is performed may be changed, and various elements of the systems illustrated herein may be added, reordered, combined, omitted, modified, etc. It is intended that the invention(s) described herein embrace all such modifications and changes and, accordingly, the above description should be regarded in an illustrative rather than a restrictive sense.

Although the invention(s) is/are described herein with reference to specific embodiments, various modifications and changes can be made without departing from the scope of the present invention(s), as set forth in the claims below. For example, although presented in the context of pinball machines, various systems and methods described herein may be implemented in other types of amusement games. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. A method, comprising:

electronically determining a physical property of a physical object, wherein the physical object is allowed to move above a display and within a playfield of a pinball machine, wherein the physical object includes at least one of: a pinball, a flipper, a slingshot, a kicker, a bumper, a target, a plunger, a hole, a saucer, a spinner, a gate, a switch, a stopper, a ramp, or a magnet, wherein electronically determining the physical property includes using a first electromagnetic transducer array and a second electromagnetic transducer array, both of the first electromagnetic transducer array and the second electromagnetic transducer array being disposed above a surface of the playfield, the first electromagnetic transducer array being on an opposite side of the display from the second electromagnetic transducer array, the first electromagnetic transducer array comprising first electromagnetic radiation transmitters, the second electromagnetic transducer array comprising first electromagnetic radiation detectors, and wherein the first electromagnetic radiation transmitters are in at least partial direct lines-of-sight with respective one or more of the first electromagnetic radiation detectors; and rendering a virtual object on the display in response to an evaluation of the physical property.

2. The method of claim 1, wherein the physical property includes at least one of: a position of the physical object on the playfield, a speed of the physical object over the playfield, or a direction of movement of the physical object across the playfield.

3. The method of claim 2, wherein the evaluation of the physical property includes at least one of: a determination that the position of the physical object matches a predetermined position on the playfield, a determination that the speed of the physical object matches a predetermined speed over the playfield, or a determination that the direction of movement of the physical object matches a predetermined direction across the playfield.

4. The method of claim 2, wherein the evaluation of the physical property includes at least one of: a determination that the position of the physical object does not match a predetermined position on the playfield, a determination that the speed of the physical object does not match a predetermined speed over the playfield, or a determination that the direction of movement of the physical object does not match a predetermined direction across the playfield.

5. The method of claim 1, wherein rendering the virtual object includes modifying a previously-rendered virtual object to simulate a physical interaction between the physical object and the previously-rendered virtual object that results in the virtual object.

6. The method of claim 5, wherein the simulated physical interaction is of a magnitude proportional to a value of the physical property.

7. The method of claim 5, wherein modifying the previously-rendered virtual object includes at least one of: moving the previously-rendered virtual object between different positions on the display, changing a shape of the previously-rendered virtual object, changing a color of the previously-rendered virtual object, or changing a size of the previously-rendered virtual object.

8. The method of claim 1, wherein the first electromagnetic transducer array comprises second electromagnetic radiation detectors, and the second electromagnetic transducer array comprises second electromagnetic radiation transmitters, the first electromagnetic radiation transmitters and the second electromagnetic radiation detectors being in alternating positions along a first side of the display, the second electromagnetic radiation transmitters and the first electromagnetic radiation detectors being in alternating positions along a second side of the display opposite from the first side of the display.

9. A method comprising:

detecting a location of a physical object within a playfield of a pinball machine, the physical object being movable within the playfield of the pinball machine, the playfield of the pinball machine being above a display, the detecting the location comprising:

transmitting electromagnetic radiation from one or more first transmitter positioned above the display, and determining when electromagnetic radiation from the one or more first transmitter is blocked from detection by one or more first detector positioned above the display; and rendering a virtual object on the display in response to the location of the physical object.

10. The method of claim 9 further comprising detecting a speed and a direction of movement of the physical object within the playfield of the pinball machine, the virtual object being rendered in response to the speed and the direction of movement of the physical object.

11. The method of claim 9, wherein rendering the virtual object includes modifying a previously-rendered virtual object on the display to simulate a physical interaction between the physical object and the previously-rendered virtual object that results in the virtual object.

12. The method of claim 9, wherein the detecting the location further comprises:

transmitting electromagnetic radiation from first transmitters of a first transducer array, the first transducer array being positioned above the display and along a first side of the display, the one or more first transmitter being at least a part of the first transmitters;

transmitting electromagnetic radiation from second transmitters of a second transducer array, the second transducer array being positioned above the display and along a second side of the display opposite from the first side; and determining when electromagnetic radiation is blocked from detection by first detectors of the second transducer array and second detectors of the first transducer array, the one or more first detector being at least part of the first detectors, the first transmitters and the second detectors being positioned in an alternating manner within the first transducer array, the second transmitters and the first detectors being positioned in an alternating manner within the second transducer array.

13. The method of claim 9, wherein the electromagnetic radiation from one or more first transmitter is infrared (IR) light.

14. A machine comprising:

a display positioned below a pinball machine playfield, a physical object being movable within the pinball machine playfield;

a first transmitter transducer above the display and along a first side of the display;

a first detector transducer above the display and along a second side of the display opposite from the first side, the first detector transducer being in a line-of-sight of the first transmitter transducer;

non-transitory memory configured to store program instructions; and one or more processor configured to execute the program instructions, the program instructions including instructions for determining a location of the physical object within the pinball machine playfield when the first detector transducer does not receive a signal from the first transmitter transducer, and for causing the display to render a virtual object in response to the location.

15. The machine of claim 14 further comprising:

a first transducer array above the display and along the first side of the display, the first transducer array comprising first transmitter transducers and second detector transducers, the first transmitter transducer being at least a part of the first transmitter transducers; and a second transducer array above the display and along the second side of the display, the second transducer array comprising second transmitter transducers and first detector transducers, the first detector transducer being at least a part of the first detector transducers.

16. The machine of claim 15, wherein the first transmitter transducers and the second detector transducers are in alternating positions within the first transducer array along the first side of the display, and the second transmitter transducers and the first detector transducers are in alternating positions within the second transducer array along the second side of the display.

* * * * *